United States Patent [19]

Crystal

[11] 3,951,060

[45] Apr. 20, 1976

[54] PROCESS FOR PREPARING WATERLESS LITHOGRAPHIC MASTERS

[75] Inventor: Richard G. Crystal, Dallas, Tex.

[73] Assignee: Xerox Corporation, Stamford, Conn.

[22] Filed: Dec. 27, 1973

[21] Appl. No.: 428,961

[52] U.S. Cl. ..... 101/150; 101/128.4; 101/467; 101/401.1; 427/270; 427/387; 156/4

[51] Int. Cl.[2] ..... B41M 1/10

[58] Field of Search... 101/128.2–128.4, 455, 463, 101/466, 467, 470, 471, 395, 401.1, 426; 156/4, 5; 117/6, 35.5, 38, 62.1, 161 ZA, 117/132 BS; 96/35, 36, 36.2–36.4

[56] References Cited

UNITED STATES PATENTS

| | | | |
|---|---|---|---|
| 2,708,289 | 5/1955 | Collings | 117/161 ZA |
| 3,002,848 | 10/1961 | Clark | 117/161 ZA |
| 3,215,527 | 11/1965 | Johnson | 101/401.1 |
| 3,243,410 | 3/1966 | McVannel | 117/161 ZA |
| 3,322,537 | 5/1967 | Giaimo | 96/1.1 |
| 3,368,483 | 2/1968 | Storms | 101/463 |
| 3,479,320 | 11/1969 | Bostick | 117/161 ZA |
| 3,487,123 | 12/1969 | Bauer et al. | 117/161 ZA |
| 3,682,633 | 8/1972 | Curtin | 101/463 X |
| 3,833,401 | 9/1974 | Ingram | 117/38 |

*Primary Examiner*—Clyde I. Coughenour
*Attorney, Agent, or Firm*—James J. Ralabate; James P. O'Sullivan; Donald M. MacKay

[57] ABSTRACT

A process for preparing a waterless lithographic printing master is provided. A suitable substrate which is preferably ink accepting is coated with a silicone which is curable at low or ambient temperature and which contains in addition to its own catalyst a high temperature catalyst. The silicone is then cured at least on its surface to render it nontacky. A particulate image pattern is deposited on the cured silicone which pattern comprises a material which at elevated temperature combines with the high temperature catalyst to degrade the cured silicone below said image pattern, the composite heated to degrade the silicon below the image pattern and render the nonimaged areas ink releasing to the extent the silicone was not previously rendered ink releasing, and the particulate image pattern and preferably the degraded silicone removed beneath said pattern to reveal the ink accepting substrate in image configuration.

20 Claims, 5 Drawing Figures

PROCESS FOR PREPARING WATERLESS LITHOGRAPHIC MASTERS

BACKGROUND OF THE INVENTION

This invention relates to a novel method for preparing waterless lithographic printing masters, particularly of the planographic type, and to a method for printing from said masters.

In conventional lithography an aqueous fountain solution is employed to prevent the ink from wetting the non-imaged areas of the planographic plate. It has recently been discovered that the requirement for a fountain solution can be obviated by employing a planographic plate having a silicone, i.e. organopolysiloxane, elastomeric layer. Because the silicone is not wetted by the printing ink, no fountain solution is required. While the use of silicone elastomers as a printing surface has obviated the requirement for a fountain solution, it has been found that finely divided particulate material commonly referred to in the trade as "toner", is not easily attached to the silicone. Thus, the abhesive or non-adhesive property of the silicone which renders it useful for rejecting lithographic inks, also causes it to reject other materials such as toner. Accordingly, it has been difficult to prepare a printing master in which the toner could be sufficiently attached to the silicone such that it would not become removed after a short run on a printing press. It is this problem to which this invention is directed.

BRIEF DESCRIPTION OF THE INVENTION

It has now been discovered that a particulate image need not be adhered to a silicone elastomer to provide a long-lasting waterless lithographic plate. More particularly, it has been found that a normally ink releasing silicone can be imaged and rendered ink accepting or the ink releasing silicone removed from a suitable ink accepting substrate in image configuration to permit printing from said substrate.

The process for preparing the printing master comprises coating a suitable substrate, which is preferably ink accepting, with a silicone which is curable at low or ambient temperature, and which contains, in addition to its own catalyst, a high temperature catalyst. The silicone is then cured at least on its surface to render it nontacky. A particulate image pattern is deposited on the cured silicone, said pattern comprising a material which at elevated temperature combines with the high temperature catalyst to selectively degrade the cured silicone below said image pattern. The composite is then heated for a time and temperature sufficient to degrade the cured silicone below said image pattern and render the nonimaged areas ink releasing to the extent the silicone was not previously rendered ink releasing, and the particulate image pattern removed and preferably the degraded silicone beneath said pattern to reveal an ink-accepting substrate in image configuration. In a preferred embodiment, the substrate is coated with an RTV gum containing its own catalyst and a high temperature peroxide catalyst which does not activate the gum at room temperature. The gum is then cured, and a particulate image pattern deposited thereon, preferably a thermoplastic polymer of styrene. The resultant imaged plate is then heated at an elevated temperature for a time and temperature sufficient to degrade the cured silicone below the image pattern, and the particulate image pattern removed to reveal an ink-accepting silicone having a rough topology or the particulate image pattern and underlying silicone removed to reveal the ink-accepting substrate. The imaged master is then preferably subjected to a post-baking step to increase its durability in the image areas. Quite surprisingly, it has been found that particulate materials, such as thermoplastic polymers, will combine with a cured silicone containing a catalyst to degrade the cured silicone and also render it ink accepting. Thus a cured silicone can be conveniently imaged without permanently adhering particulate material thereto. Further, because the pre-imaged master is cured at least on its surface, it can be stored prior to imaging without adhering to other materials or picking up dust, dirt and the like. Thus the disadvantages found with storing nonimaged uncured silicone gums are overcome in accordance with the invention. Other advantages will be apparent from the following detailed description.

DETAILED DESCRIPTION OF THE INVENTION

Figure 1:
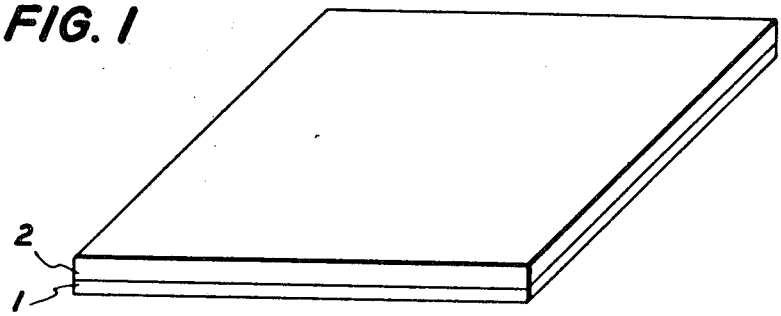
FIG. 1 depicts the printing master of the invention and its structure.

Substrates which can be employed for the printing master are those self-supporting materials to which the silicone can adhere and be compatible therewith as well as possess sufficient heat and mechanical stability to permit use under widely varying conditions and in a preferred embodiment of the invention be ink accepting. Exemplary of suitable substrates are paper; metals such as aluminum; and plastics such as polyester polycarbonate, polysulfone, nylon and polyurethane.

Exemplary of suitable silicone gums are those having only methyl containing groups in the polymer chain such as polydimethylsiloxane; gums having both methyl and phenyl containing groups in the polymer chain as well as gums having both methyl and vinyl groups, methyl and fluorine groups, or methyl, phenyl, and vinyl groups in the polymer chain.

Exemplary of suitable room temperature vulcanizable gums which can be cured at ambient temperature and atmospheric conditions include RTV-108, 106 and 118 polydimethylsiloxane gums available from General Electric Company.

Room temperature vulcanizable gums can be cured by using polyfunctional silanes and siloxanes as cross-linking agents together with certain catalysts. The preferred cross-linking agents are methoxy and ethoxy silanes or polysiloxanes because of their reactivity.

Catalysts suitable for the low temperature vulcanizable (LTV) silicone gums or the gums curable at ambient or room temperature (RTV) depend upon the type of gum employed and are supplied by the manufacturer of the gum. Typical catalysts are amines and carboxylic acid salts of many metals such as lead, zirconium, zinc antimony, iron, cadmium, tin, barium, calcium, and manganese, particularly the napthanates, octoates hexoates, laurates and acetates. Tin (II) octoate and dibutyl tin dilaurate with a chloroacetic acid have been widely used. Gums which react at room temperature (RTV types) can be adjusted to vulcanize at only slightly elevated temperatures (LTV types) by the choice of suitable combinations of cross-linking agent and catalyst but also by absorbing the catalyst in a zeolite (molecular sieve). It is then inactive at room temperature and is activated by heating. Typical LTV types are cured at temperatures between 50° and 80°C. The particular catalyst and temperature employed, however, will depend on the particular type of silicone as is well known to those skilled in the art. The gums curable at room temperature have molecular weights of between about 10,000 to 100,000.

The silicones can be applied to the substrate by conventional techniques such as solvent casting techniques including dip coating or draw bar coating, etc. after dissolution in organic solvents which typically may be solvents such as benzene, hexane, heptane, tetrahydrofuran, toluene, xylene, as well as other common aliphatic and aromatic solvents.

The thickness of the coating will depend on the type of silicone and catalyst employed. Generally, the silicone coating should be between 1 and 15 microns thick. A preferred range is between 2 and 8 microns. A silicone surface layer which is quite thin is more easily degraded by the conventional toners, however, the silicone, should be sufficiently thick such that the non-image areas can withstand extended periods on the printing press.

Suitable high temperature catalysts for the silicone gums of the conventional type which have been heretofore employed and which will react with the particulate imaging material to degrade the silicone include the diaroyl peroxides such as dibenzoyl peroxide, di-p-chlorobenzoyl peroxide and bis-2,4-dichlorobenzoyl peroxide. Other catalysts include the dialkyl peroxides such as di-t-butyl peroxide and 2,5-dimethyl-2,5-di-(t-butylperoxy)-hexane. Diaralkyl peroxides such as dicumyl peroxide, and alkyl aralkyl peroxides such as t-butyl cumyl peroxide can be employed, as well as blocked diisocyanates. Other catalysts which can be employed include the azo compounds such as azo-bis-isobutyronitrile as well as other conventional free radiacal catalysts. The "high temperature" catalysts are those which are activated at elevated temperature such as between about 100°C and 200°C or more. The amount of catalyst employed will depend on the silicone employed but with the preferred peroxide catalysts such as 2,4-dichlorobenzoyl peroxide, best results are obtained in a catalyst concentration of between 3 and 5 percent by weight of solids in the gum or polymer.

The particulate image pattern can be deposited by conventional techniques such as electrophotography, electrostatic printing, photoelectrophoresis and electrographic imaging. The particulate image is preferably developed on a separate photoconductive surface and electrostatically transferred to an intermediate member before transfer to the silicone gum. The means of development of the image will be dictated by the particular image technique, but insofar as conventional xerography is employed the image can be developed by cascade, magnetic brush and powder cloud development methods.

The particulate material or toner used to form the image should be one which will combine with the high temperature catalyst contained in the surface silicone to degrade said silicone. Conventional toners which will combine with conventional high temperature catalysts to degrade typical polydimethylsiloxane cured LTV and RTV polymers include thermoplastic polymers such as polymers of styrene. Typical styrene polymers include polystyrene, styrene n-butyl-methacrylate copolymer and styrene-butadiene copolymer. Other materials which can be employed include: polyethylene, polypropylene, ethylene-vinyl acetate copolymers, propylene-modified polyethylene, acetals, acrylics, acrylonitrilebutadiene-styrene (ABS), polystyrene, cellulosics, chlorinated polyether, fluoro-chemicals, polyamides (nylons), polyimides, phenoxies and vinyls. It is only necessary that the toner combine with the catalyst to degrade the cured surface silicone, and thus a number of materials can be employed.

Typical solvents which can be employed to remove the particulate toner and the degraded silicone below said toner include aliphatics such as hexane; aromatics such as toluene and xylene and chlorinated solvents such as chloroform and tetrachlorethylene. One or more solvents may be required to remove both the silicone and the toner to reveal the ink accepting substrate. The selection of solvents depends upon the particular toner and silicone employed.

In a preferred embodiment, the resultant master is subjected to a post-baking step after removal of the toner and the underlying silicone which serves to insure the silicone is fully cured around the image areas and thus lengthen the life of the master.

Typical inks can be employed in the printing method of the invention to include inks of the oleophilic type having the vehicle component for the ink pigments derived from various oleophilic materials such as aromatic and aliphatic hydrocarbons drying oil varnishes, lacquers, and solvent type resins. Other suitable inks include the glycol and rubber based inks.

The "imaged" printing master can thereafter be employed in a planographic printing operation, including direct or offset lithography with the dampening system removed, to provide good quality prints over an extended period of operation.

Figure 2:
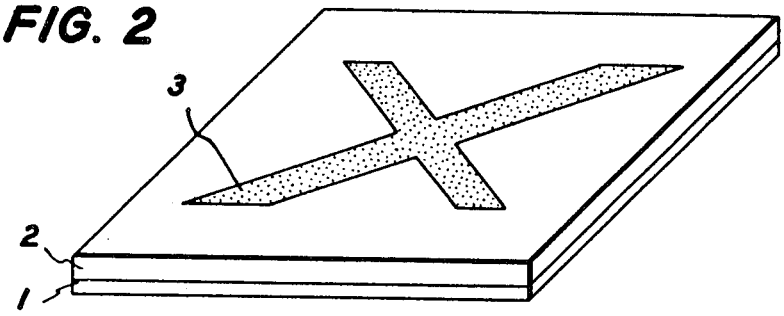
FIG. 2 depicts the printing master of the invention imaged with a deposited particulate image pattern.
Figure 3A:
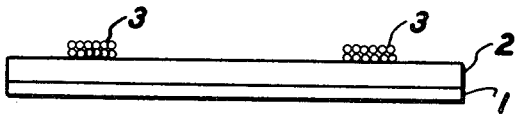
FIG. 3(*a*) shows a side view of the printing master of the invention after the particulate image pattern is deposited, FIG. 3(*b*) shows a side view of the printing master after imagewise degradation of the silicone.
Figure 3B:
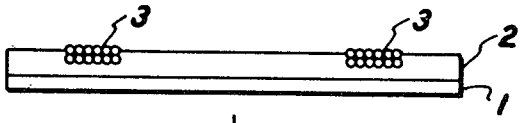
Figure 4:
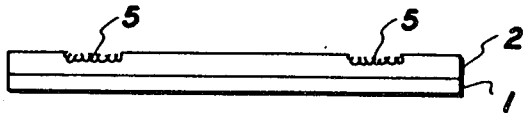
FIG. 4 shows a side view of the printing master of the instant invention after removal of the particulate image pattern.

Referring specifically to FIG. 1, number 1 is the substrate and 2 a silicone surface layer. In FIG. 2, the particulate image pattern 3 is illustrated as deposited on the surface of the ink releasable silicone layer 2. FIGS. 3*a*, 3*b* and 4 are side views of the master with number 5 depicting the image pores resulting from removal of the particulate image pattern.

The following examples will serve to illustrate the invention and embodiments thereof. All parts and percentages in said examples and elsewhere in the specification and claims are by weight unless otherwise specified.

EXAMPLE I

A printing master is prepared is follows. A smooth aluminum sheet 11 × 15 in. is draw bar coated with a 5 micron thick layer of a solution comprising an equal by weight mixture of RTV polydimethylsiloxane gum (General Electric TS-50) (10 percent total solids in heptane and 2,4-dichlorobenzoyl peroxide. (The RTV gum contains its own catalyst and thus the peroxide catalyst is added to combine with the particulate image pattern added later herein to degrade the silicone after it is cured and imaged). The gum is then fully cured in air by allowing the coated sheet to remain at room temperature for 2 hours. An electrostatographic latent test image was then deposited and cascade developed on a paper using the Xerox Model D Processor, and the particulate image pattern electrostatically transferred to the cured silicone. The particulate image pattern was developed with Xerox 3600 toner containing styrene-n-butylmethacrylate copolymer. The resultant imaged sheet was then placed in an air circulating oven for 5 minutes at a temperature of 140°C. The particles from said particulate image pattern and the silicone below said pattern were then removed by wiping first with acetone to remove the toner followed by heptane to remove the degraded silicone. The resultant printing master was then mounted on a printing press in both the direct and offset modes and 500 copies of good image contrast were obtained employing a conventional lithographic ink (Pope and Gray No. 2441) and no fountain solution. There was no detectable wear or background buildup with the use of the master.

EXAMPLE II

The procedure of Example I is repeated but for the exception that the gum coated plate is allowed to remain at room temperature for 18 hours before imaging. Similar results were obtained and the cured silicone was considerably harder and less susceptible to abrasion due to more complete curing.

EXAMPLES III–IV

In accordance with the general procedure of Example I, two additional plates were prepared and imaged two days and seven days after fabrication, respectively, with similar results.

EXAMPLES V–VIII

The procedure of Examples I–IV is repeated but for the exception that chloroform is employed to remove both the silicone and the toner. Similar results are obtained.

EXAMPLES IX–XII

The process of Examples I–IV is repeated but for the exception that benzoyl peroxide is substituted for 2,4-dichlorobenzoyl peroxide. Similar results are obtained although the images are not as clearly defined.

EXAMPLE XIII

In accordance with the procedure of Example I, a printing master is prepared in which the imaged cured plate is washed only with acetone, a solvent for the toner, resulting in silicone ink accepting imaged areas having a rough topology. The resultant master is inked and prints of good quality are obtained from it.

EXAMPLE XIV

The procedure of Example I is repeated but with the exception that after removal of the toner and the degraded silicone, the imaged master is subjected to a post-baking step of 30 seconds at 130°C in an air circulating oven. It is found that the silicone is strengthened such that the life of the master is extended on a printing press.

EXAMPLE XV

The procedure of Example I is repeated but with the exception that a styrene-butadiene block copolymer is employed as the toner.

EXAMPLE XVI

The procedure of Example I is repeated but for the exception that a polystyrene is employed as the toner. Copies of good image contrast are obtained.

EXAMPLE XVII

The procedure of Example I is repeated but for the exception that polyethylene is employed as the toner. Copies of good image contrast are obtained.

Having described the present invention with reference to these specific embodiments, it is to be understood that numerous variations may be made without departing from the spirit of the present invention and it is intended to encompass such reasonable variations or equivalents within its scope.

What is claimed is:

1. A process for preparing a printing master comprising:

a. providing a suitable substrate;

b. providing a silicone which becomes nontacky when cured and contains a low temperature catalyst and a high temperature catalyst independently reactable, c. coating said substrate with said silicone, d. curing said silicone at least on its surface to render it nontacky by means of said low temperature catalyst, e. providing particles comprising a material which at elevated temperatures can combine with said high temperature catalyst to degrade the cured silicone, f. depositing said particles and forming an image pattern on said cured silicone, g. heating the composite of (a), (c) and (f) to said high temperature and thus degrading the silicone below the image pattern and rendering the nonimaged silicone areas ink releasing to the extent said silicone was not previously rendered ink releasing, and h. providing an ink accepting rough topography by removing the particulate image pattern.

2. The process of claim 1 wherein the curable silicone is an RTV gum containing a peroxide catalyst.

3. The process of claim 1 wherein after removal of the particulate image pattern, the resultant member is subjected to a post-baking step.

4. The process of claim 1 wherein the silicone when cured is between 2 and 8 microns thick.

5. The process of claim 1 wherein the particulate image pattern comprises a thermoplastic polymer.

6. The process of claim 5 wherein the thermoplastic polymer is a polymer of styrene.

7. The process of claim 1 wherein the curable silicone is an RTV gum containing a peroxide catalyst and the particulate image pattern comprises a thermoplastic polymer.

8. The process of claim 1 wherein the curable silicone is an RTV gum containing a 2,4-dichlorobenzoyl peroxide catalyst and the particulate image pattern comprises a polymer of styrene.

9. The process of claim 1 wherein after removal of the particulate image pattern, the resultant master is inked, and the inked image transferred to a receiver member.

10. The process of claim 1 wherein the high temperature catalyst is a free radical catalyst.

11. A process for preparing a printing master comprising:

a. providing an ink accepting substrate, b. providing a silicone which becomes nontacky when cured and contains a low temperature catalyst and a high temperature catalyst independently reactable, c. coating said substrate with said silicone, d. curing said silicone at least on its surface to render it nontacky by means of said low temperature catalyst, e. providing particles comprising a material which at elevated temperatures can combine with said high temperature catalyst to degrade the cured silicone, f. depositing said particles and forming an image pattern on said cured silicone, g. heating the composite of (a), (c) and (f) to said high temperature and thus degrading the silicone below the image pattern and rendering the nonimaged silicone areas ink releasing to the extent said silicone was not previously rendered ink releasing, and h. providing an ink accepting rough topography by removing the particulate image pattern.

12. The process of claim 11 wherein the curable silicone is an RTV gum containing a peroxide catalyst.

13. The process of claim 11 wherein after removal of the particulate image pattern and underlying silicone, the resultant master is subjected to a post-baking step.

14. The process of claim 11 wherein the silicone when cured is between 2 and 8 microns thick.

15. The process of claim 11 wherein the particulate image pattern comprises a thermoplastic polymer.

16. The process of claim 15 wherein the thermoplastic polymer is a polymer of styrene.

17. The process of claim 11 wherein the curable silicone is an RTV gum containing a peroxide catalyst and the particulate image pattern comprises a thermoplastic polymer.

18. The process of claim 11 wherein the curable silicone is an RTV gum containing a 2,4-dichlorobenzoyl peroxide catalyst and the particulate image pattern comprises a polymer of styrene.

19. The process of claim 11 wherein after removal of the particulate image pattern and underlying silicone the resultant master is inked and the inked image transferred to a receiver member.

20. The process of claim 11 wherein the high temperature catalyst is a free radical catalyst.

* * * * *